US011433515B2

(12) United States Patent
Su

(10) Patent No.: US 11,433,515 B2
(45) Date of Patent: Sep. 6, 2022

(54) TOOL ADAPTER

(71) Applicant: Hong Ann Tool Industries Co., Ltd., Taichung (TW)

(72) Inventor: Cheng-Wei Su, Taichung (TW)

(73) Assignee: Hong Ann Tool Industries Co., Ltd., Taichung (TW)

( * ) Notice: Subject to any disclaimer, the term of this patent is extended or adjusted under 35 U.S.C. 154(b) by 0 days.

(21) Appl. No.: 17/179,594

(22) Filed: Feb. 19, 2021

(65) Prior Publication Data

US 2021/0379740 A1 Dec. 9, 2021

(30) Foreign Application Priority Data

Jun. 4, 2020 (TW) ..... 109118803

(51) Int. Cl.
*B25B 23/00* (2006.01)
*B25B 21/00* (2006.01)

(52) U.S. Cl.
CPC ..... *B25B 23/0035* (2013.01); *B25B 21/007* (2013.01)

(58) Field of Classification Search
CPC . B25B 23/0035; B25B 23/0057; B25B 21/00; B25B 21/007; B25B 21/0007; B25B 13/06; B25B 13/065; B25B 13/481
USPC ..... 81/180.1, 177.2
See application file for complete search history.

(56) References Cited

U.S. PATENT DOCUMENTS 3,306,639 A * 2/1967 Lyon ..... F16B 7/105 403/107
2017/0001290 A1* 1/2017 Liu ..... B23B 31/107
2018/0354104 A1 12/2018 Su

FOREIGN PATENT DOCUMENTS

CN 207014254 U 2/2018
CN 208913975 U 5/2019
TW M571787 U 12/2018

* cited by examiner

*Primary Examiner* — Orlando E Aviles
*Assistant Examiner* — Jacob Adam Montgomery
(74) *Attorney, Agent, or Firm* — Karin L. Williams; Alan D. Kamrath; Mayer & Williams PC

(57) ABSTRACT

A tool adapter includes a body and a retaining device. The body has a coupling hole and a side hole interconnected with the coupling hole. The retaining device includes an outer sleeve and a retaining member. The outer sleeve is movable relative to the body and is provided with an interacting portion. The retaining member has an engaging portion arranged in the side hole, a first portion arranged on an outer periphery of the body, and a bend portion located between the engaging portion and the first portion. The interacting portion releasably abuts against the bend portion in response the movement between the outer sleeve and the body.

10 Claims, 10 Drawing Sheets

TOOL ADAPTER

BACKGROUND OF THE INVENTION

The present invention relates to a tool adapter, and more particularly to a tool adapter changeably retaining or coupling different tools.

U.S. Patent Publication No. US-2018-0354104-A1 discloses a tool adapter, which includes a main body having a first engaging end adapted to engage with the power tool and a second engaging end adapted to receive a driving head respectively and a device adapted to retain the driving head. The second engaging end includes a receptacle adapted to receive the driving head. The main body includes a hole communicated with the receptacle. The hole extends radially from the receptacle to an outer periphery of the main body. The outer periphery of the main body includes a first threaded portion. The device includes a retaining member disposed in the hole and a sleeve mounted on the outer periphery of the main body and threadedly engaged with the first threaded portion. An inner periphery of the sleeve includes a second threaded portion engaged with the first threaded portion and an interacting portion adapted to interact with the retaining member.

However, the driving head is retained and prevented from moving out of the receptacle due to the friction from the retaining member pushing the driving head. When the torque generated by the power tool is too large, the driving head will easily be loosened from the receptacle.

Thus, a need exists for a novel tool adapter that mitigates and/or obviates the above drawbacks.

BRIEF SUMMARY OF THE INVENTION

A tool adapter according to the present invention includes a body and a retaining device. The body has a driving end and a coupling end opposite to the driving end. The coupling end is provided with a coupling hole recessed along an elongated axis extending through the driving end and the coupling end. The coupling hole is extended from the coupling end towards the driving end. The body is provided with a side hole extended along a radial direction of the elongated axis. One end of the side hole is interconnected with the coupling hole, and another end of the side hole is connected with an outer periphery of the body. The retaining device includes an outer sleeve and a retaining member. The outer sleeve is sleeved on the body and movable relative to the body between a first position and a second position. A side of the outer sleeve adjacent to the body is provided with an interacting portion. The retaining member has an engaging portion arranged in the side hole, a first portion arranged on the outer periphery of the body, and a bend portion located between the engaging portion and the first portion. The interacting portion abuts against the bend portion when the outer sleeve is in the first position. The interacting portion detaches from the bend portion when the outer sleeve is in the second position.

In an example, the outer sleeve is movable relative to the body between the first position and the second position along a direction parallel to the elongated axis.

In an example, the outer periphery of the body is provided with a first annular portion. The first annular portion is provided with a groove extended along the direction parallel to the elongated axis and aligned with the side hole. The first portion is arranged in the groove.

In an example, the outer periphery of the body is further provided with a second annular portion, and an annular recess disposed between the first annular portion and the second annular portion A radial width of the annular recess is less than a radial width of the first annular portion or a radial width of the second annular portion. The retaining member further has a second portion connected to an end of the first portion opposite to the bend portion and arranged in the annular recess. The groove forms a first width along a circumferential direction of the body. The second portion forms a second width along the circumferential direction of the body, and the first width is less than the second width.

In an example, a bottom of the annular recess is provided with a bottom arc face and a bottom flat face. A distance from the bottom flat face to the elongated axis is less than a distance from the bottom arc face to the elongated axis. The bottom flat face is adjacent to the second portion. The retaining member is formed as an integral structure, the second portion is formed in a shape of a curved plate, and the engaging portion and the first portion are formed in a shape of a flat plate, respectively.

In an example, the retaining device further includes a spiral ring sleeved on the body and located in annular recess, and wherein the spiral ring abuts against a side of the second portion opposite to the body.

In an example, the spiral ring is formed by bending a metal wire wrapping several loops around the body.

In an example, the first annular portion, the second annular portion, and the annular recess are disposed between the side hole and the coupling end. The interacting portion has a conical surface, and a radial width of an end of the interacting portion adjacent to the driving end is less than a radial width of another end of the interacting portion adjacent to the coupling end.

In an example, the outer periphery of the body is further provided with an annular slot extended along the circumferential direction of the body and disposed between the side hole and the driving end. A side of the outer sleeve adjacent to the body is provided with an abutment face extended towards the elongated axis. The retaining device further includes a retaining ring sleeved on the body and arranged in the annular slot, and an elastic member having two ends respectively abutting against the abutment face and the retaining ring to push the outer sleeve to move to the first position.

In an example, the coupling hole has six driving faces arranged in an inner periphery thereof and extended along the direction parallel to the elongated axis.

In another example, the first annular portion, the second annular portion, and the annular recess are disposed between the side hole and the driving end.

In another example, the outer periphery of the body is further provided with an annular slot extended along the circumferential direction of the body and disposed between the side hole and the coupling end.

The present invention will become clearer in light of the following detailed description of illustrative embodiments of this invention described in connection with the drawings.

DETAILED DESCRIPTION OF THE INVENTION

Figure 1:
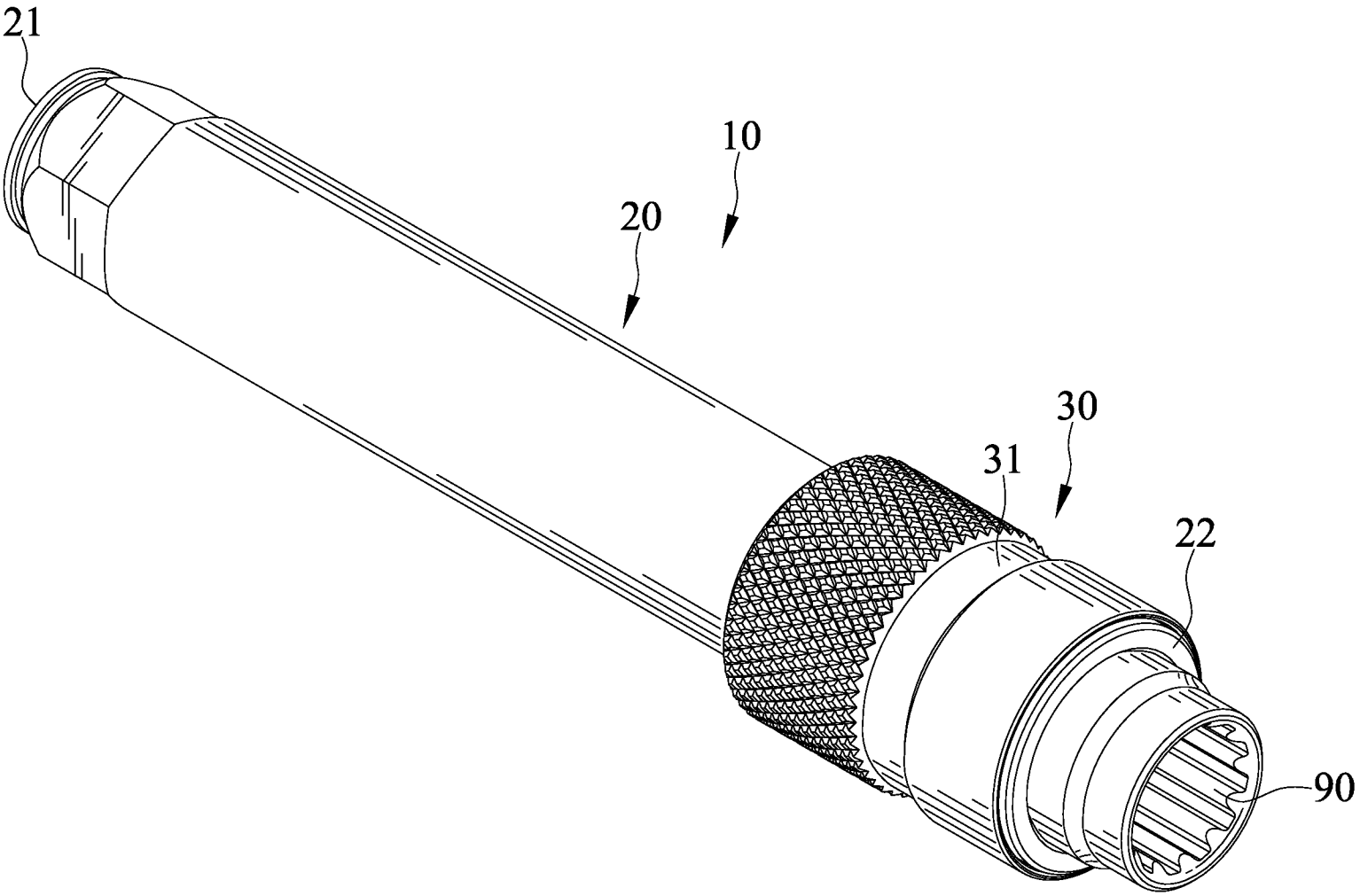
FIG. 1 is a perspective view of a tool adapter of a first embodiment according to the present invention.
Figure 2:
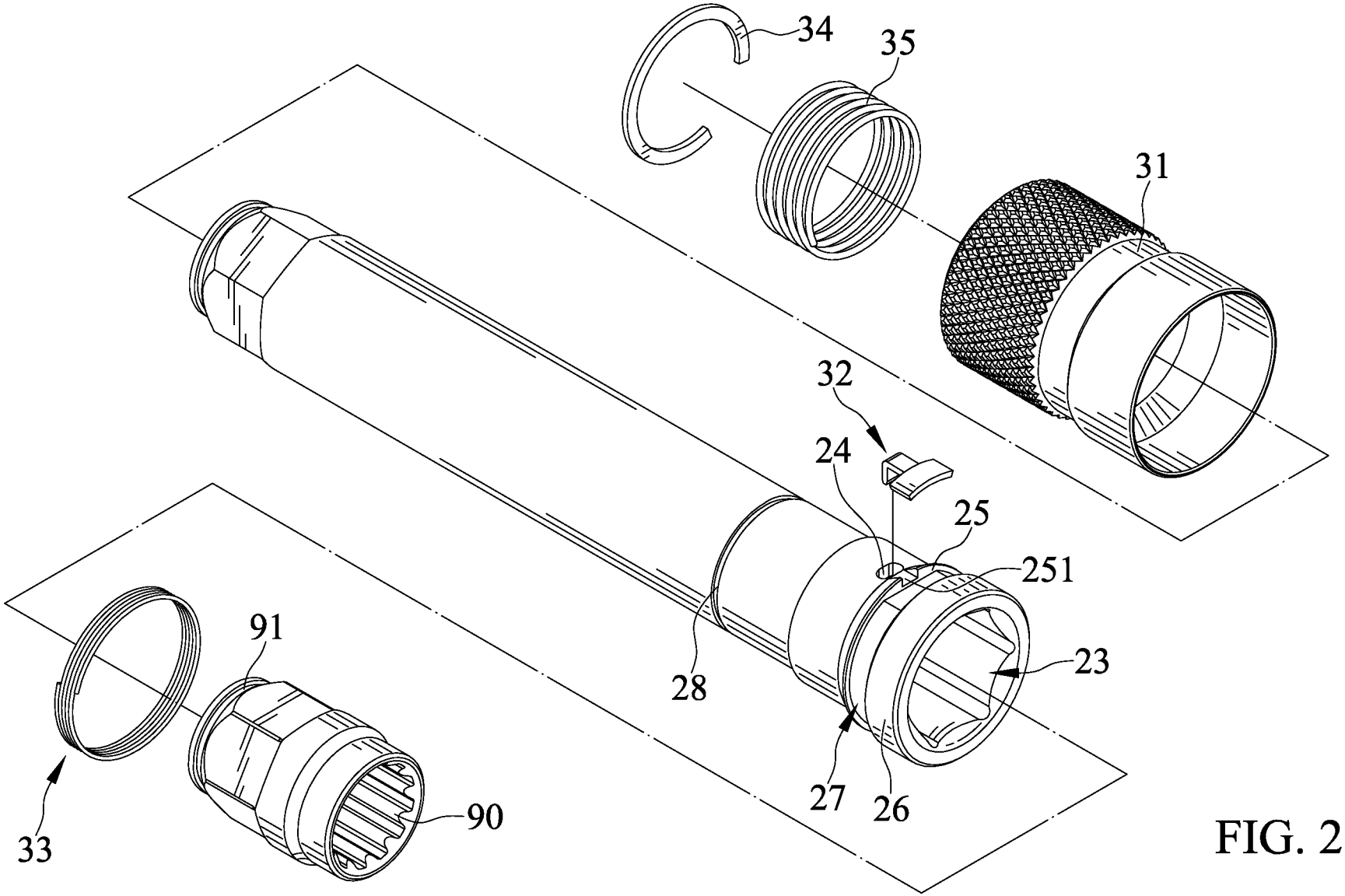
FIG. 2 is an exploded, perspective view of the tool adapter of FIG. 1.
Figure 3:
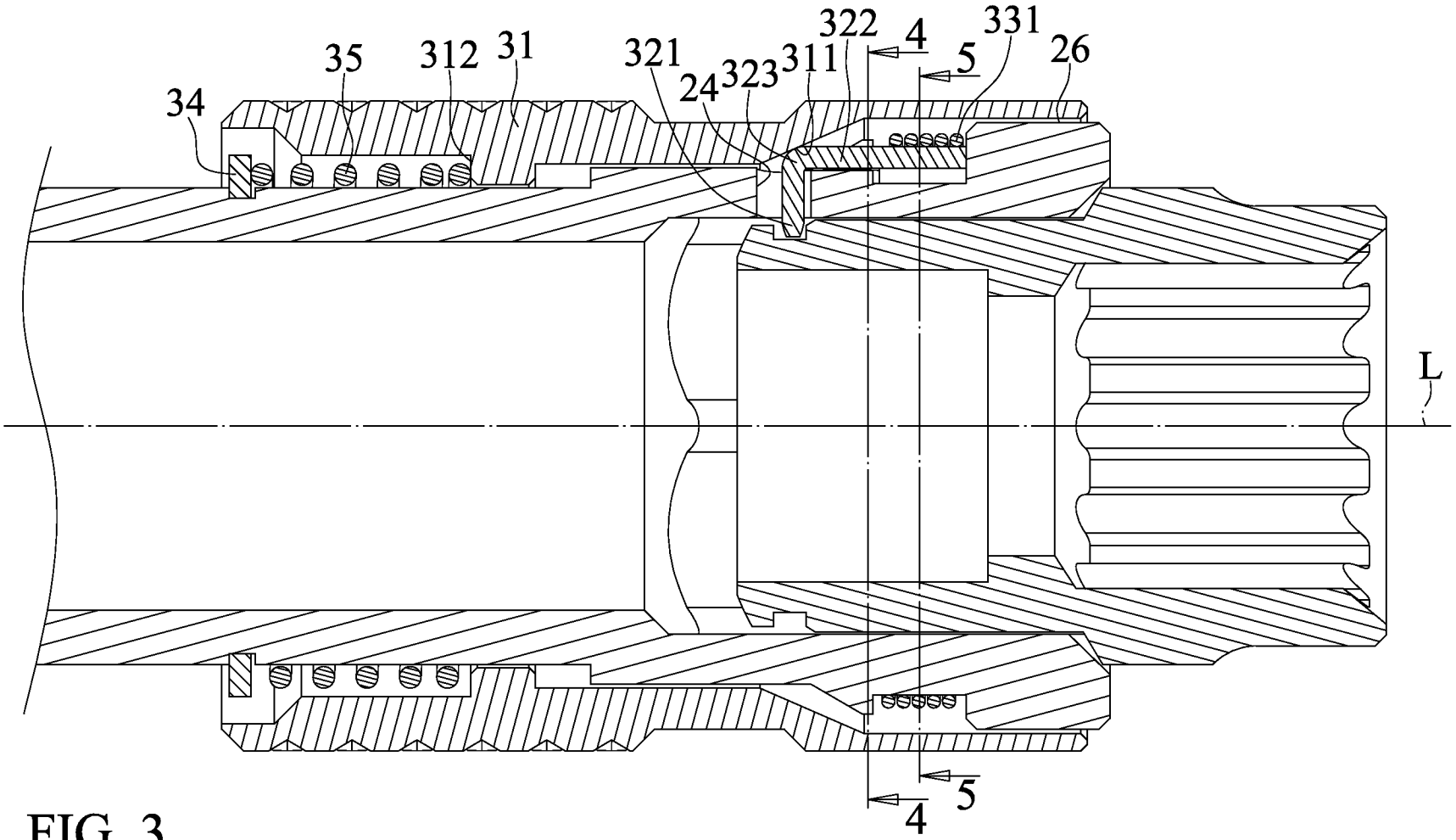
FIG. 3 is a cross sectional view of the tool adapter of FIG. 1.
Figure 4:
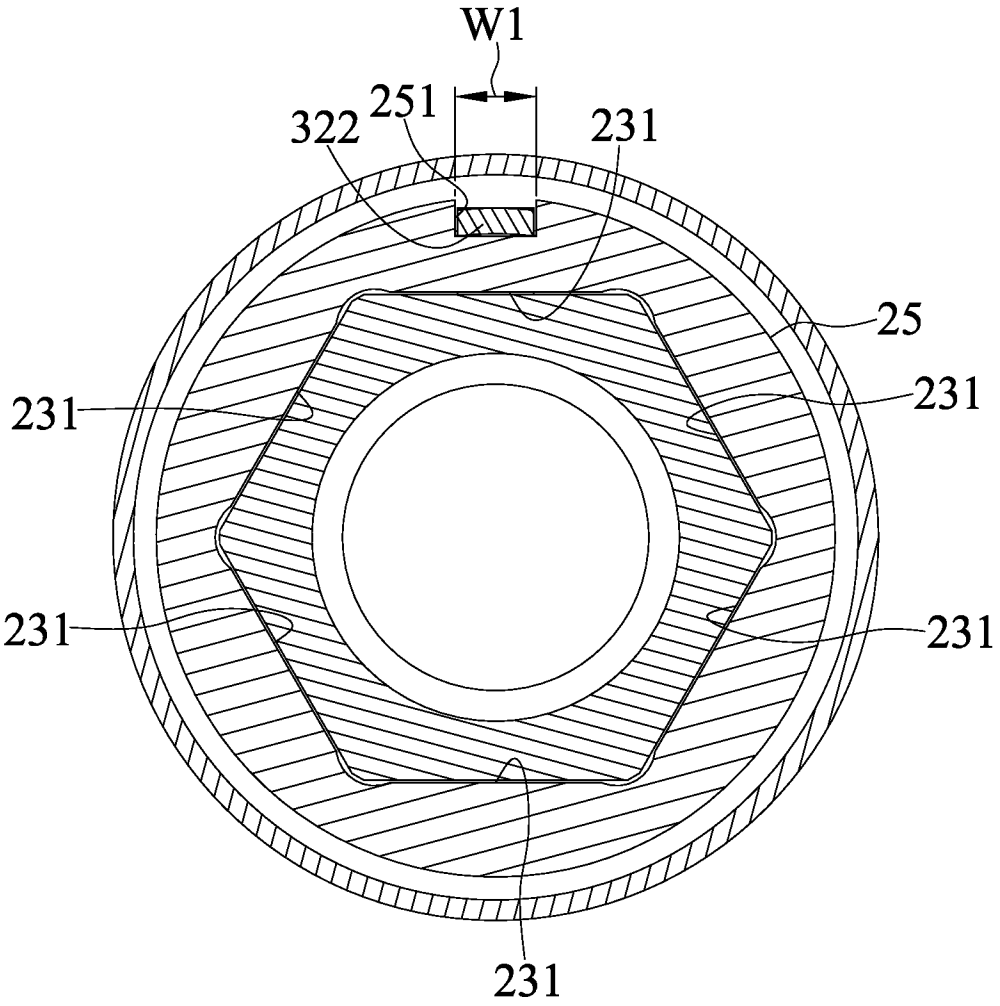
FIG. 4 is a cross sectional view taken along line 4-4 of FIG. 3.
Figure 5:
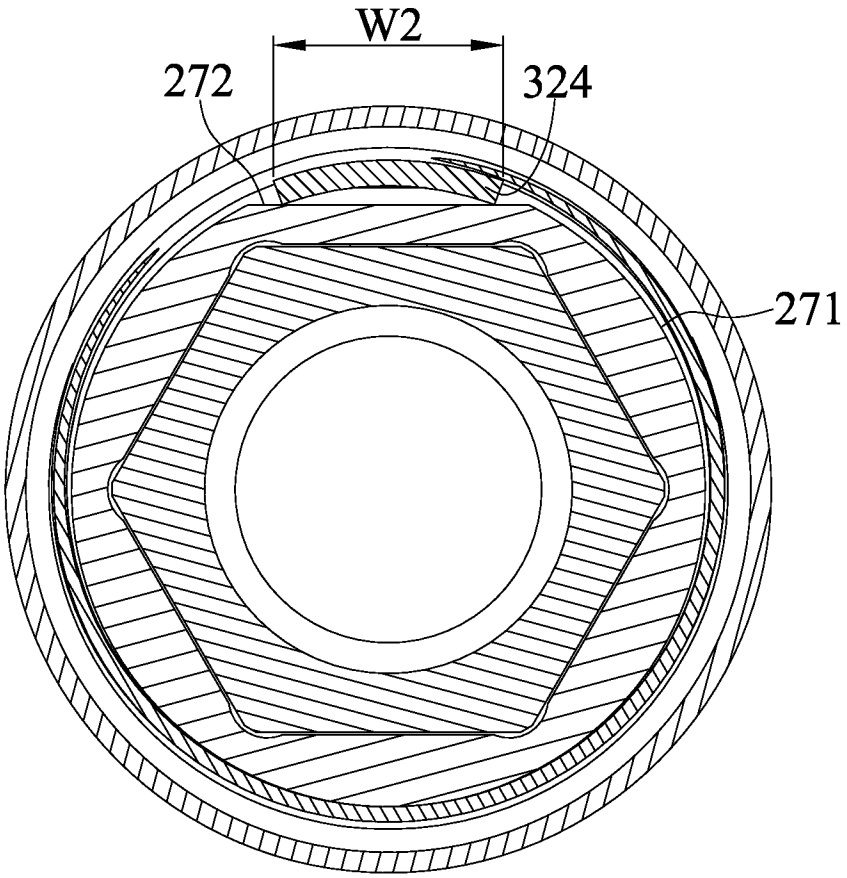
FIG. 5 is a cross sectional view taken along line 5-5 of FIG. 3.
Figure 6:
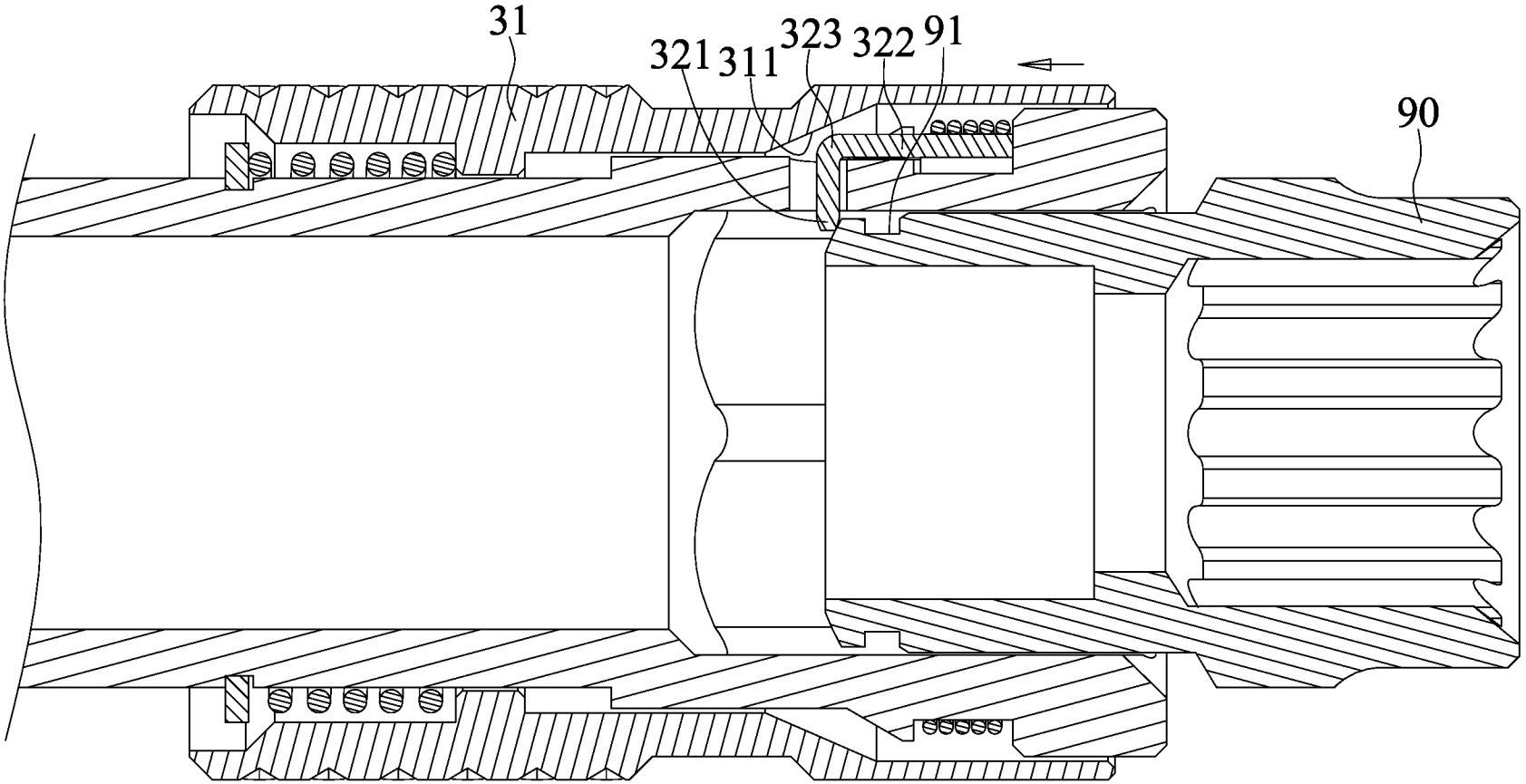
FIG. 6 is a cross sectional view of the tool adapter of FIG. 1 and illustrates an outer sleeve moving from a first position to a second position.
Figure 7:
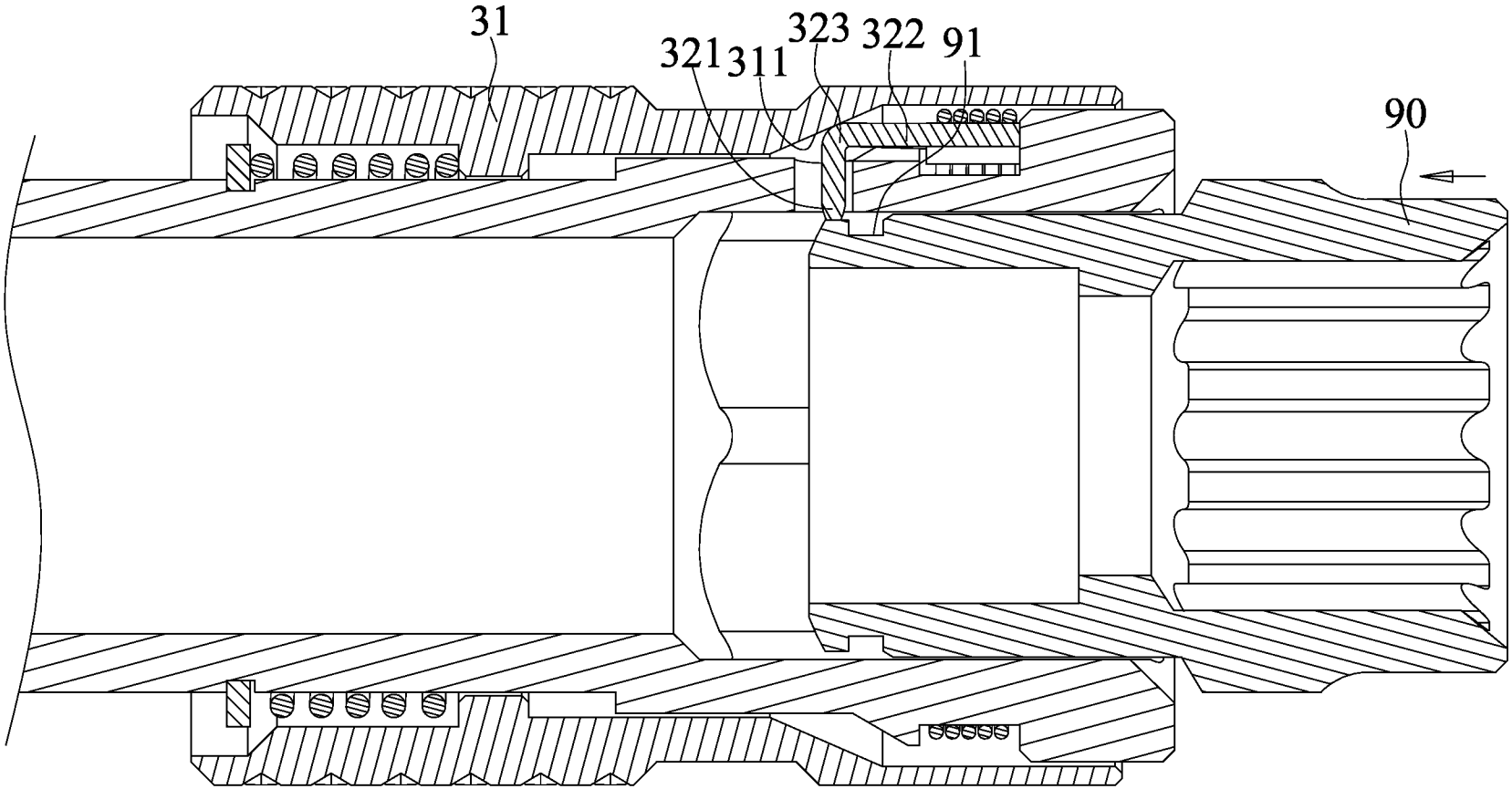
FIG. 7 is a continued view of FIG. 6 and illustrates a socket inserted into a coupling hole.

FIGS. 1-7 show a tool adapter 10 of a first embodiment according to the present invention. The tool adapter 10 includes a body 20 and a retaining device 30.

The body 20 has a driving end 21 adapted for connecting to a power tool (not shown) and a coupling end 22 opposite to the driving end 21. The coupling end 22 is provided with a coupling hole 23 recessed along an elongated axis L, which extends through the driving end 21 and the coupling end 22. The coupling hole 23 is extended from the coupling end 22 towards the driving end 21. The body 20 is provided with a side hole 24 extended along a radial direction of the elongated axis L. One end of the side hole 24 is interconnected with the coupling hole 23, and another end of the side hole 24 is connected with an outer periphery of the body 20.

The retaining device 30 includes an outer sleeve 31 and a retaining member 32. The outer sleeve 31 is sleeved on the body 20 and is movable relative to the body 20 between a first position and a second position. An inner side of the outer sleeve 31 adjacent to the body 20 is provided with an interacting portion 311. The retaining member 32 has an engaging portion 321 arranged in the side hole 24, a first portion 322 arranged on the outer periphery of the body 20, and a bend portion 323 located between the engaging portion 321 and the first portion 322. The interacting portion 311 of the outer sleeve 31 abuts against the bend portion 323 of the retaining member 32 when the outer sleeve 31 is in the first position. The interacting portion 311 of the outer sleeve 31 detaches from the bend portion 323 of the retaining member 32 when the outer sleeve 31 is in the second position.

In the embodiment, the outer sleeve 31 can be movable relative to the body 20 between the first position and the second position along a direction parallel to the elongated axis L.

The outer periphery of the body 20 is provided with a first annular portion 25, which is provided with a groove 251 extended along the direction parallel to the elongated axis L and aligned with the side hole 24. The first portion 322 of the retaining member 32 is arranged in the groove 251 of the first annular portion 25.

The outer periphery of the body 20 is further provided with a second annular portion 26, and an annular recess 27 disposed between the first annular portion 25 and the second annular portion 26. A radial width of the annular recess 27 is less than a radial width of the first annular portion 25 or a radial width of the second annular portion 26. The retaining member 32 further has a second portion 324 connected to an end of the first portion 322 opposite to the bend portion 323 and arranged in the annular recess 27. The groove 251 forms a first width W1 along a circumferential direction of the body 20, and the second portion 324 forms a second width W2 along the circumferential direction of the body 20. The first width W1 is less than the second width W2 (shown in FIGS. 4 and 5).

A bottom of the annular recess 27 is provided with a bottom arc face 271 and a bottom flat face 272. A distance from the bottom flat face 272 to the elongated axis L is less than a distance from the bottom arc face 271 to the elongated axis L. The bottom flat face 272 is adjacent to the second portion 324. The retaining member 32 is formed as an integral or monobloc structure. The second portion 324 is formed in a shape of a curved plate, and the engaging portion 321 and the first portion 322 are formed in a shape of a flat plate, respectively.

The retaining device 30 further includes a spiral ring 33 sleeved on the body 20 and located in annular recess 27. The spiral ring 33 abuts against a side of the second portion 324 opposite to the body 20.

In the embodiment, the spiral ring 33 is formed by bending a metal wire 331 wrapping several loops around the body 20.

The first annular portion 25, the second annular portion 26, and the annular recess 27 are disposed between the side hole 24 and the coupling end 22.

The interacting portion 311 has a conical surface, and a radial width of an end of the interacting portion 311 adjacent to the driving end 21 is less than a radial width of another end of the interacting portion 311 adjacent to the coupling end 22.

The outer periphery of the body 20 is further provided with an annular slot 28 extended along the circumferential direction of the body 20 and disposed between the side hole 24 and the driving end 21. A side of the outer sleeve 31 adjacent to the body 20 is provided with an abutment face 312 extended towards the elongated axis L. The retaining device 30 further includes a retaining ring 34 sleeved on the body 20 and arranged in the annular slot 28, and an elastic member 35 having two ends respectively abutting against the abutment face 312 and the retaining ring 34 to push the outer sleeve 31 to move to the first position.

The coupling hole 23 has six driving faces 231 arranged in an inner periphery thereof and extended along the direction parallel to the elongated axis L.

The tool adapter 10 can provide a good retaining effect through the above structure. When the tool adapter 10 is in use, the socket 90 can be inserted into the coupling hole 23, and then the six driving faces 231 of the coupling hole 23 can rotate the socket 90. After the socket 90 is inserted into the coupling hole 23, the engaging portion 321 of the retaining member 32 is engaged with the engaging groove 91 of the socket 90 to ensure the socket 90 not moving out of the coupling hole 23 in the first position.

Figure 8:
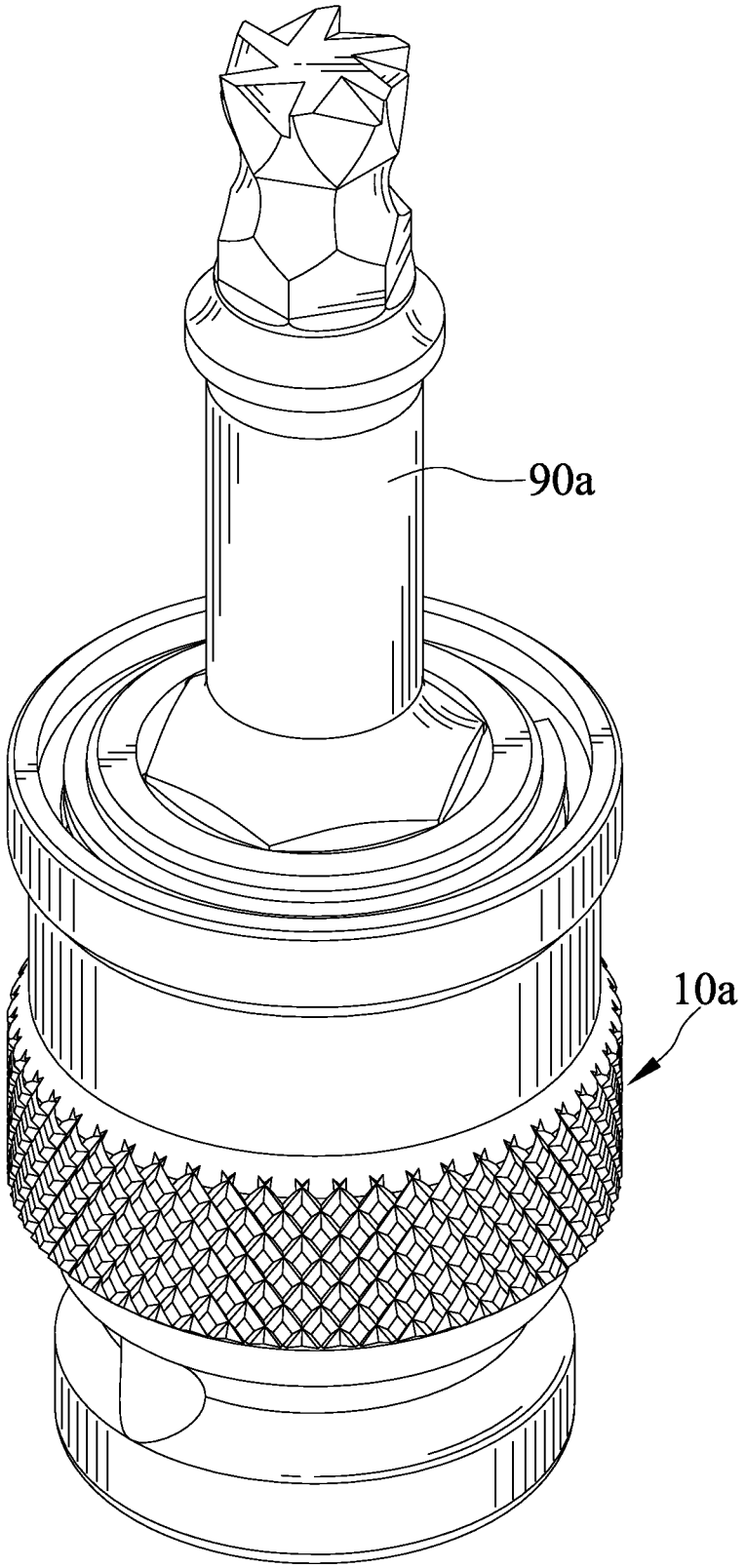
FIG. 8 is a perspective view of a tool adapter of a second embodiment according to the present invention.
Figure 9:
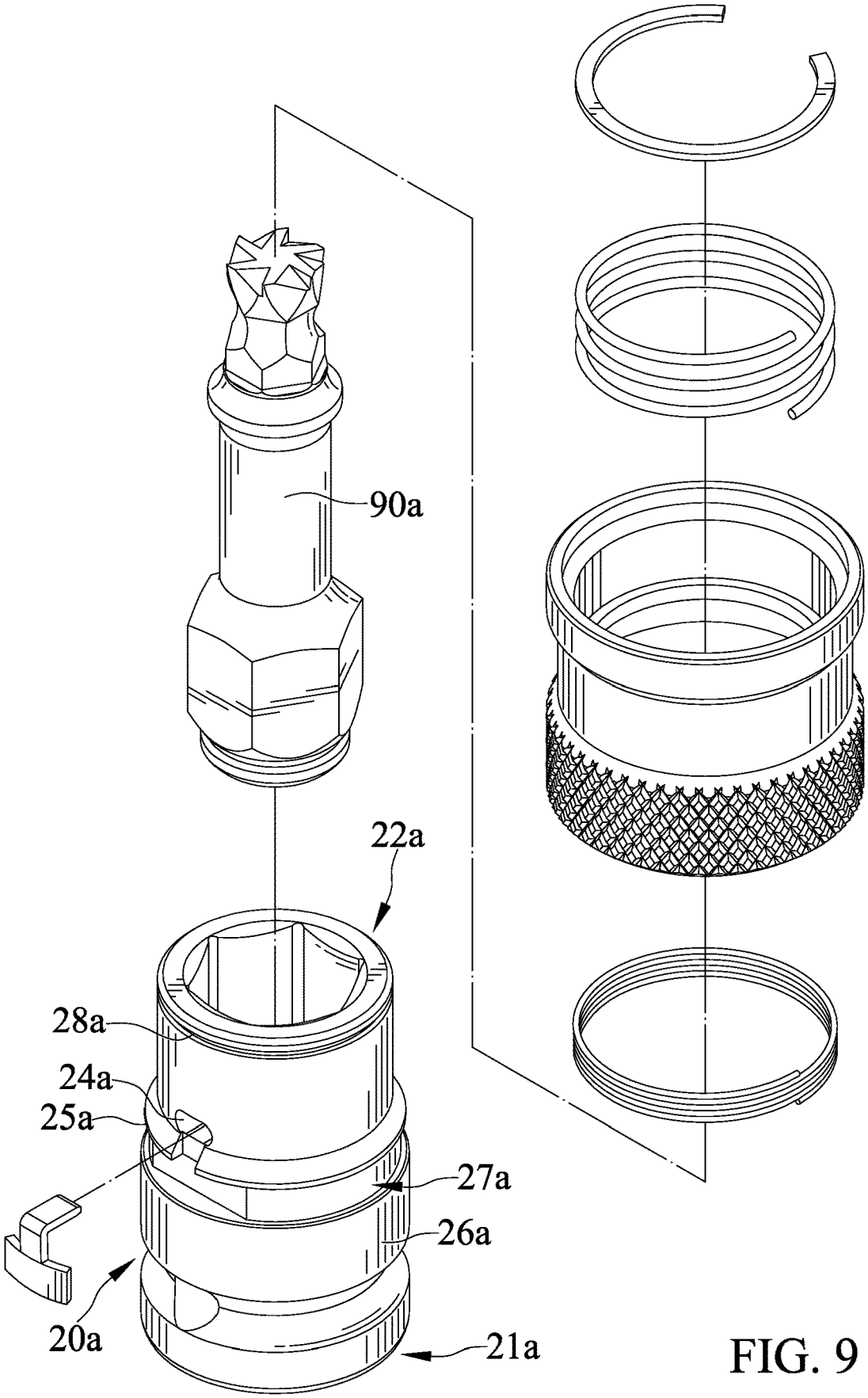
FIG. 9 is an exploded, perspective view of the tool adapter of FIG. 8.
Figure 10:
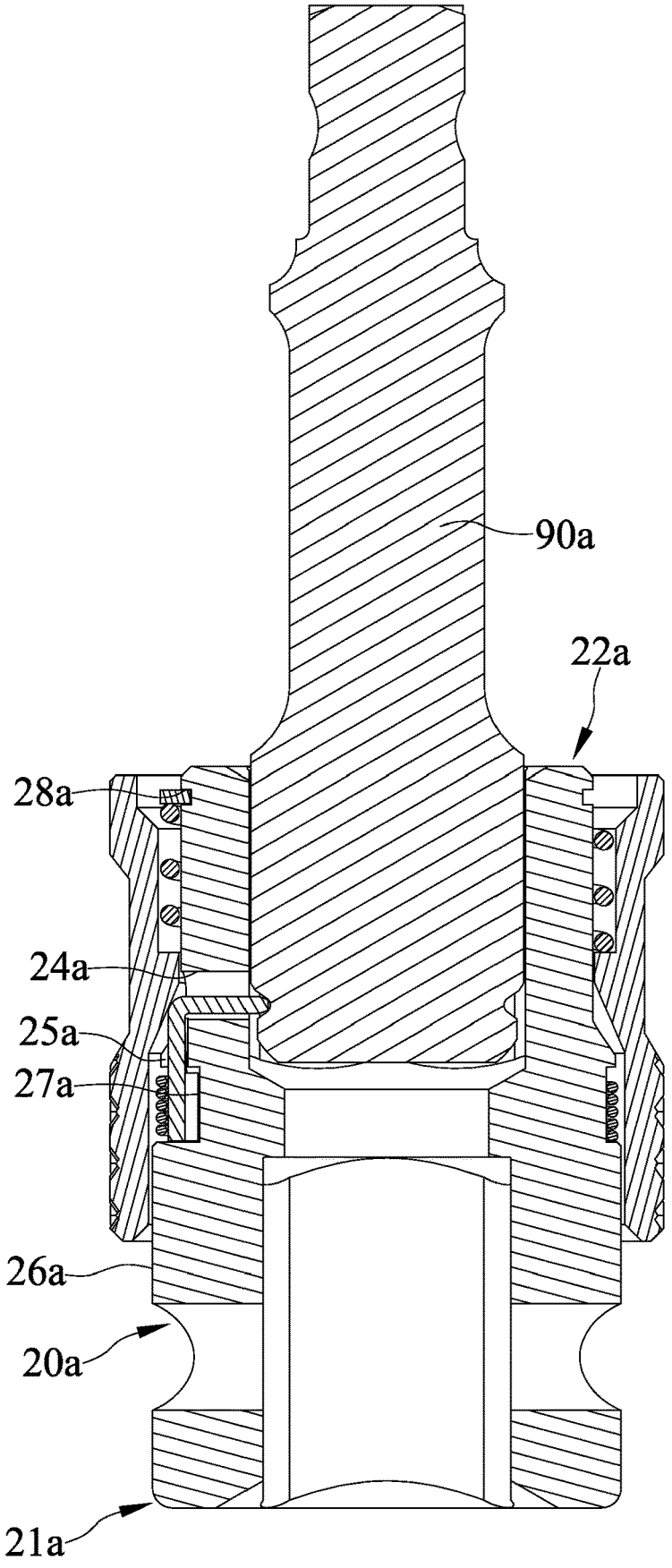
FIG. 10 is a cross sectional view of the tool adapter of FIG. 8.

FIGS. 8-10 show a tool adapter 10*a* of a second embodiment according to the present invention. The second embodiment is substantially the same as the first embodiment. The second embodiment is different from the first embodiment in that the first annular portion 25*a*, the second annular portion 26*a*, and the annular recess 27*a* are disposed between the side hole 24*a* and the driving end 21*a*. The outer periphery of the body 20*a* is further provided with an annular slot 28*a* extended along the circumferential direction of the body 20*a* and disposed between the side hole 24*a* and the coupling end 22*a*. Further, the coupling end 22*a* can connected with an end milling cutter 90*a*.

Although specific embodiments have been illustrated and described, numerous modifications and variations are still possible without departing from the scope of the invention. The scope of the invention is limited by the accompanying claims.

The invention claimed is:

1. A tool adapter comprising:

a body having a driving end and a coupling end opposite to the driving end, wherein the coupling end is provided with a coupling hole recessed along an elongated axis extending through the driving end and the coupling end, wherein the coupling hole is extended from the coupling end towards the driving end, wherein the body is provided with a side hole extended along a radial direction of the elongated axis, wherein one end of the side hole is interconnected with the coupling hole, and another end of the side hole is connected with an outer periphery of the body; and a retaining device including an outer sleeve and a retaining member, wherein the outer sleeve is sleeved on the body and movable relative to the body between a first position and a second position, wherein a side of the outer sleeve adjacent to the body is provided with an interacting portion, wherein the retaining member has an engaging portion arranged in the side hole, a first portion arranged on the outer periphery of the body, and a bend portion located between the engaging portion and the first portion;

wherein the interacting portion abuts against the bend portion when the outer sleeve is in the first position;

wherein the interacting portion detaches from the bend portion when the outer sleeve is in the second position, wherein the outer sleeve is movable relative to the body between the first position and the second position along a direction parallel to the elongated axis, and wherein the outer periphery of the body is provided with a first annular portion, wherein the first annular portion is provided with a groove extended along the direction parallel to the elongated axis and aligned with the side hole, and wherein the first portion is arranged in the groove.

2. The tool adapter as claimed in claim 1, wherein the outer periphery of the body is further provided with a second annular portion, and an annular recess disposed between the first annular portion and the second annular portion, wherein a radial width of the annular recess is less than a radial width of the first annular portion or a radial width of the second annular portion, wherein the retaining member further has a second portion connected to an end of the first portion opposite to the bend portion and arranged in the annular recess, wherein the groove forms a first width along a circumferential direction of the body, wherein the second portion forms a second width along the circumferential direction of the body, and wherein the first width is less than the second width.

3. The tool adapter as claimed in claim 2, wherein a bottom of the annular recess is provided with a bottom arc face and a bottom flat face, wherein a distance from the bottom flat face to the elongated axis is less than a distance from the bottom arc face to the elongated axis, wherein the bottom flat face is adjacent to the second portion, wherein the retaining member is formed as an integral structure, wherein the second portion is formed in a shape of a curved plate, and wherein the engaging portion and the first portion are formed in a shape of a flat plate, respectively.

4. The tool adapter as claimed in claim 3, wherein the retaining device further includes a spiral ring sleeved on the body and located in the annular recess, and wherein the spiral ring abuts against a side of the second portion opposite to the body.

5. The tool adapter as claimed in claim 4, wherein the spiral ring is formed by bending a metal wire wrapping several loops around the body.

6. The tool adapter as claimed in claim 4, wherein the first annular portion, the second annular portion, and the annular recess are disposed between the side hole and the coupling end, wherein the interacting portion has a conical surface, and wherein a radial width of an end of the interacting portion adjacent to the driving end is less than a radial width of another end of the interacting portion adjacent to the coupling end.

7. The tool adapter as claimed in claim 6, wherein the outer periphery of the body is further provided with an annular slot extended along the circumferential direction of the body and disposed between the side hole and the driving end, wherein a side of the outer sleeve adjacent to the body is provided with an abutment face extended towards the elongated axis, and wherein the retaining device further includes a retaining ring sleeved on the body and arranged in the annular slot, and an elastic member having two ends respectively abutting against the abutment face and the retaining ring to push the outer sleeve to move to the first position.

8. The tool adapter as claimed in claim 7, wherein the coupling hole has six driving faces arranged in an inner periphery thereof and extended along the direction parallel to the elongated axis.

9. The tool adapter as claimed in claim 4, wherein the first annular portion, the second annular portion, and the annular recess are disposed between the side hole and the driving end.

10. The tool adapter as claimed in claim 6, wherein the outer periphery of the body is further provided with an annular slot extended along the circumferential direction of the body and disposed between the side hole and the coupling end.

* * * * *